United States Patent [19]

Krob et al.

[11] 4,239,256

[45] Dec. 16, 1980

[54] SKI BRAKE

[75] Inventors: Erwin Krob, Vienna; Erwin Weigl, Brunn am Gebirge, both of Austria

[73] Assignee: TMC Corporation, Zug, Switzerland

[21] Appl. No.: 51,183

[22] Filed: Jun. 22, 1979

Related U.S. Application Data

[63] Continuation of Ser. No. 824,709, Aug. 15, 1977, abandoned.

[30] Foreign Application Priority Data

Sep. 16, 1976 [AT] Austria ..... 6891/76

[51] Int. Cl.[3] ..... A63C 17/10

[52] U.S. Cl. ..... 280/605

[58] Field of Search ..... 280/605, 12 AB; 188/5, 188/8

[56] References Cited

U.S. PATENT DOCUMENTS

| | | | |
|---|---|---|---|
| 3,964,760 | 6/1976 | Riedel | 280/605 |
| 3,989,271 | 11/1976 | Riedel | 280/605 |
| 4,012,057 | 3/1977 | Courvoisier | 280/605 |
| 4,014,563 | 3/1977 | Weigl et al. | 280/605 |
| 4,059,284 | 11/1977 | Schwarz | 280/605 |
| 4,062,562 | 12/1977 | Riedel | 280/605 |
| 4,078,824 | 3/1978 | Riedel | 280/605 |
| 4,078,825 | 3/1978 | Riedel | 280/605 |
| 4,078,826 | 3/1978 | Riedel | 280/605 |
| 4,138,137 | 2/1979 | Beyl | 280/605 |

FOREIGN PATENT DOCUMENTS

| | | | |
|---|---|---|---|
| 2429719 | 1/1975 | Fed. Rep. of Germany | 280/605 |
| 2710539 | 10/1977 | Fed. Rep. of Germany | 280/605 |
| 2301275 | 9/1976 | France | 280/605 |

*Primary Examiner*—David M. Mitchell

*Attorney, Agent, or Firm*—Blanchard, Flynn, Thiel, Boutell & Tanis

[57] ABSTRACT

A ski brake mechanism for preventing the runaway of a ski after the release of same from a ski boot which is held on the ski by a ski binding. The ski brake includes an approximately U-shaped braking bar which is provided with braking arms which lie on both sides of the ski and are pivotally supported about an axis which lies at a right angle with respect to the longitudinal axis of the ski. The braking bar can be swung, loaded by a spring, with downwardly projecting arms into the braking position and can be swung into the ready position above the upper surface of the ski when the ski boot is inserted into the ski binding by means of a stepping plate. The spring is an approximately U-shaped spring bar which is bent from spring wire and is supported in a mounting plate on the ski and spaced longitudinally a distance from the braking bar. The braking bar and the spring bar are pivotally connected by interpositioning of the stepping plate through carrier parts.

16 Claims, 10 Drawing Figures

SKI BRAKE

This is a continuation of application Ser. No. 824,709 filed Aug. 15, 1977 and now abandoned.

FIELD OF THE INVENTION

The invention relates to a ski brake to prevent the sliding or runaway of a ski after release of same from a ski boot initially held on the ski by ski bindings. The ski brake consists of braking arms positioned on both sides of the ski and are attached to a braking bar which is pivotally supported on the ski. The braking bar, loaded by a spring, is held in the braking position by a downwardly extending arm and is held in the ready position above the upper surface of the ski by the ski boot engaging a stepping plate when the ski boot is inserted in the ski binding.

BACKGROUND OF THE INVENTION

Ski brakes of this type are known in various constructions. The ski brakes which more closely relate to the abovementioned subject matter are described for example in German OS No. 24 12 623, in the associated addition applications which are published in German OS Nos. 24 36 155 and 25 07 371, furthermore, in German OS No. 25 31 466. All these constructions have in common the torsion-springlike construction of the entire braking bar. This has the disadvantage that the torsion force which is produced in the braking bar is the greatest in the ready or cocked position of the ski brake and when the ski boot is clamped in the ski bindings. As a result, the foot of the skier is pushed by the largest possible spring force. This situation is disadvantageous for holding down the ski boot in the ski binding since the release point of the ski binding must be adjusted with consideration being given to the torsional stand-up force stored in the spring wire bar. A further disadvantage consists in that in a one-piece manufacture of the bar, two opposed conditions must be met. First, the brake arms must be produced of a wire which is as strong as possible in order to avoid bending. Second, the dimensions of the spring wire of which the braking bar consists may not be chosen particularly large, because otherwise the earlier already mentioned torsion force, which the skier must overcome, will be too great and also the holding mechanism of the entire braking bar will have undesired dimensions. To avoid these disadvantages, it was suggested according to Austrian Auslegeschrift No. A 1803/75 to design the braking bar with additional extensions which are associated with the stepping plate, wherein the braking arms and in particular the segment which is stressed for bending consist of two wire materials, however, the one-piece manufacture of such a brake is for technical manufacturing reasons associated with particularly high assembly time and expense.

The already mentioned German OS No. 24 12 623 (corresponds to U.S. Pat. No. 3,989,271) describes also a further construction in which a pressure bar is associated with a stepping bar, wherein the two bars are connected by means of an intermediate bar. The known arrangement is thereby such that an extending of the intermediate bar is only possible when the stepping bar is extended. This will achieve the known pulling in of the braking arms above the upper ski surface in the ready position. In this known construction therefore the torsion force is produced only in the stepping bar and in same also only by the extending function, wherein the two bends of the stepping bar are supported at the end stop of the recess. A disadvantage of this known construction lies in the greatest force being created in the ready or cocked position and the torsion force having also to be produced by the stepping bar, so that again opposed conditions must be met.

The invention has the object of overcoming the disadvantages of the known ski brakes and to provide a ski brake in which the braking bar and the spring which loads same are constructed separately and the hold down force is smaller in the ready position of the device than in the braking position.

The object of the invention is inventively achieved by a spring, as actually known, being a barlike torsion spring which is designed from spring wire, and which torsion spring is supported on a mounting plate on the ski and wherein the torsion spring and the breaking bar are connected together through a stepping plate and between said parts there is provided a connection which permits a lost motion pivoting of the parts.

The inventive design of the ski brake permits the stand-up force to achieve its maximum magnitude in the braking position while requiring in the ready or cocked position only a small force for holding same down. This is due to the fact that the torsion force is stored exclusively in the separate spring bar and the braking bar is freed from any self contained stand-up forces. The braking bar carries out only the pivotal movement which is necessary for pulling in the ends of the braking arms in a plane which lies above the upper surface of the ski and generally parallel to said upper surface of the ski; the force pivoting the braking bar from the ready position into the braking position comes exclusively from the torsion force which is stored in the spring bar.

BRIEF DESCRIPTION OF THE DRAWINGS

For the connection between a braking bar and a spring bar through a stepping plate, various embodiments are possible which lie within the scope of the invention. These and further details or advantages of the invention will now be described with reference to the several exemplary embodiments which are illustrated in the drawings, in which:

FIGS. 1 to 3 illustrate a first exemplary embodiment, wherein FIGS. 2 and 3 are related views in which the inventive ski brake lies in the cocked or ready position and FIG. 1 is a side-elevational view of the ski brake in the braking position;

DETAILED DESCRIPTION

Figure 1:
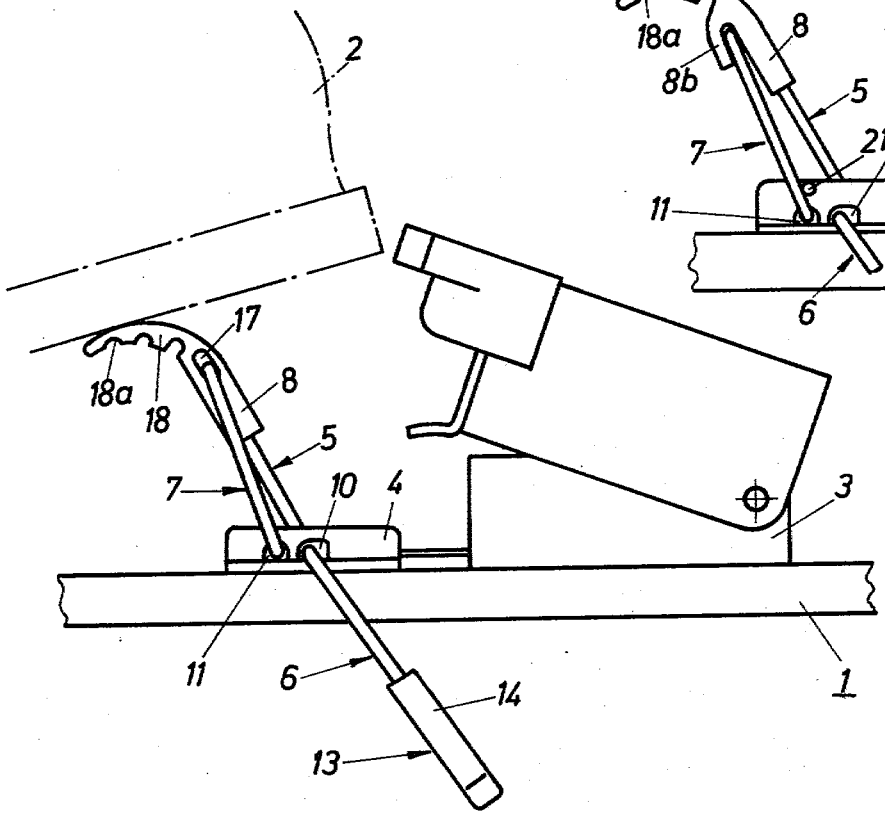

The following description identifies component parts which are the same in both exemplary embodiments with the same reference numeral, however, similar parts which fulfill the same purpose or function have been identified with the same reference numeral and the prime (') suffix to effect a differentiation therebetween.

Figure 2A:
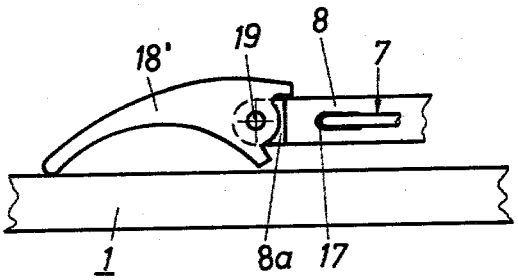
Figure 2:
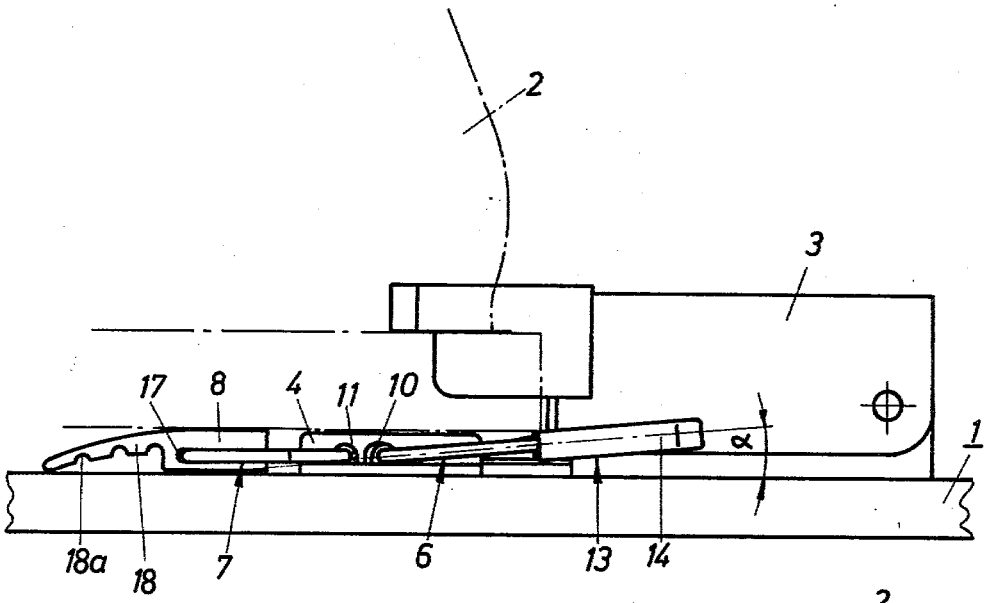
Figure 3:
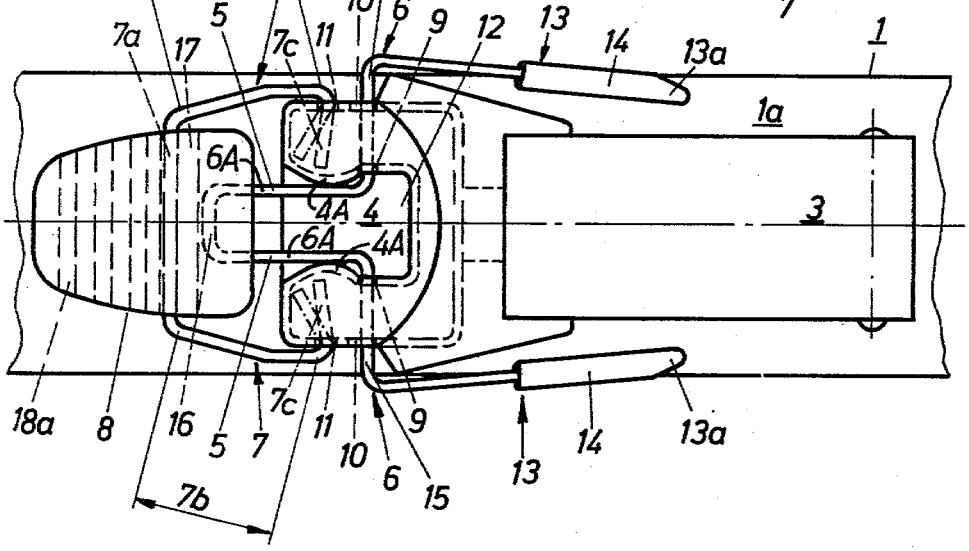

In the first exemplary embodiment according to FIGS. 1 to 3, a ski boot 2 which is shown only in FIGS. 1 and 2 is held on a ski 1 by means of a conventional ski binding 3. The ski binding 3 is not the subject matter of the present invention. The front ski binding part is not shown in the drawings but it may have any desired and known conventional construction. With reference to the ski binding 3, there is arranged adjacent thereto a mounting plate 4 for a ski brake which as a whole is identified by the reference numeral 5. The ski brake 5 is, according to FIG. 1, in the braking position, namely either in the position when the ski boot 2 is being clamped into the ski bindings or in the position when the ski boot 2 is being released from the ski binding 3, for example after a fall. The ski brake 5 thereby becomes active to retard the free sliding of the ski 1. FIGS. 2 and 3 show the ski brake 5 in the ready or cocked position, however, FIG. 3 does not show the ski boot to facilitate a better understanding of the invention.

The design of the ski brake 5 which is the subject matter of the present invention is as follows. The ski brake 5 consists of a generally U-shaped braking bar 6, a generally U-shaped spring bar 7 and a stepping plate 8 connecting the braking bar 6 and the spring bar 7 together. The braking bar 6 and the spring bar 7 are supported in pivot bearings 9 or 11 of the mounting plate 4. The braking bar is freely pivotally supported in the bearings 9 over the entire range of movement thereof without generating any torsional forces in the wire tending to return same to the upright braking position. The mounting plate 4 has a recess or notch 12 in the center area, namely where the pivot bearings 9 for the braking bars 6 are provided. The recess or notch 12 facilitates a horizontal movement of the braking bar 6 during a swing thereof in the pivot bearings 9, wherein also the possibility for a tilting exists. This measure is intended as an overloaded protection device in order to prevent a bending of the braking arms 13 when same get hung up or caught on a rigid obstacle in the ground, for example a root. The pivot bearings 11 for the spring bar 7 are provided on the lateral sides of the mounting plate 4. Free space or gaps 10 are provided in the lateral sides of the mounting plate 4 and in horizontal alignment with the pivot bearings 11 for the bent sections 15 of the braking bar 6. As a result, it is possible to pull in the free ends 13*a* of the braking arms 13 from an initial inoperative position wherein the free ends 13*a* are positioned alongside of and outwardly of the upper lateral edges of the ski to a fully inoperative position above the upper surface of the ski 1*a* and inside of the upper lateral edges of the ski when the shank portions 6A of the braking bar 6 engage the cams 4A. The degree or amount of pulling in depends on the width of the respective ski and the spacing between the brake arms 13 of the ski brake mounted on the ski as well as the size of the cam 4A. The present exemplary embodiment illustrates a ski 1, the width of which corresponds to an average value. The dimension of the inside diameter of the free ends 13*a* of the braking arms 13 is measured such that they can just yet carry out in the case of a ski of the widest width (short ski) the horizontal movement during the swing of the braking bar 6 from the ready or cocked position into the braking position and yet still effect a pulling in in the case of a narrower ski. It has proven to be preferable if the braking arms 13 as shown in FIG. 2, define an angle $\alpha$ in the fully inoperative ready or cocked position with the upper surface 1*a* of the ski 1, the magnitude of which is in the range of approximately 5° to 20°, preferably 10°. This facilitates the provision of an increase in the degree or amount of pulling in which must be accomplished for the various ski widths. A coating or covering 14, for example of plastic is provided on the free ends 13*a* of the braking arms 13. The bight portion of the U-shaped bar part 16 of the braking bar 6 lies in a recess of the stepping plate 8, which recess is not separately shown in the drawings. The stepping plate 8 has at its end remote from the braking bar an extension 18 which has an elastic characteristic in the embodiment according to FIGS. 1 to 3. For this purpose, recesses 18*a* are provided in the extension 18. The stepping plate 8 has longitudinal slots 17 provided on both sides thereof for receiving the bight portion 7*a* of the U-shaped spring bar 7. In this manner according to this exemplary embodiment a simultaneous swinging of the two bars 6 and 7 is assured without any interengagement therebetween. It must be remarked in addition that the spring bar 7 has the two torsion areas, 7*b* between the bight portion 7*a* which acts as neutral zone and the bent free ends or offset segments 7*c*. As will be recognized from FIG. 3, the free ends 7*c* of the spring bar 7 lie in the ready or cocked position of the ski brake so that they extend approximately parallel to the bent sections 15 of the braking bar 6 (see the dashed position thereof in FIG. 3) and when in the braking position of the ski brake they lie in the dash-dotted position. This arrangement shows that the torsion in the torsion area 7*b* caused by a swinging of the braking bar 6 in the pivot bearings 11 toward the ready or cocked position is produced by the changed position of the free ends 7*c*. Only in order to be complete it is remarked that a neutral zone in the bight portion 7*a* is created by the fact that the torsion forces which are produced at opposite ends thereof by the two side portions 7*b* are effectively cancelled.

The elastic construction of the extension 18 is provided for the purpose of facilitating a better adjustment to the sole of the ski boot 2. As will be recognized from FIGS. 1*a* and 2*a*, which show similar positions of the areas of the stepping plate 8 and which are associated with FIGS. 1 and 2, a construction is also possible in which an extension 18' is pivotally connected to the free end 8*a* of the stepping plate 8 by means of a pivot axle 19. A spring 20 can, if desired, be arranged between a projection on the extension 18' and the stepping plate 8. The spring 20 has either a length through which an engagement of the extension 18' on the stepping plate 8 in the braking position is effected in order to assure a good support for the sole of the ski boot 2, or is dimensioned so strongly that it can cooperate in the release of the ski boot 2.

Figure 2B:
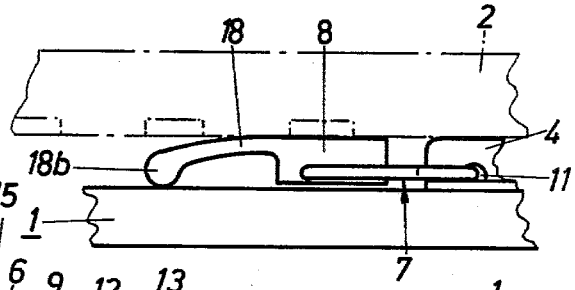

For the purpose of facilitating a perfect functioning of the ski brake with a one-piece stepping plate 8, it will be preferable if the free end of the extension 18 extends in a rounded portion 18*b* as shown in FIG. 2*b*. It will be recognized that in this development of the stepping plate 8, a catching of the ski brake 5 along the lower side of the sole of the ski boot 2 is not possible even when same is provided with special recesses or the like.

Figure 1B:
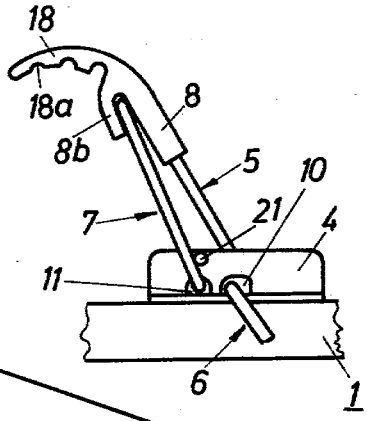
FIGS. 1*a*, 2*a*, 1*b* and 2*b* are further constructions of the stepping plate in positions corresponding to FIG. 1 or FIG. 2.
Figure 1A:
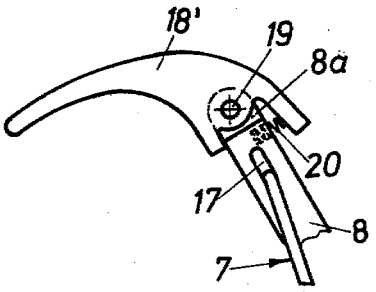

A further modification of the connection between the braking bar 6 and the spring bar 7 exists in the stepping plate 8 having according to FIG. 1*b* a hook portion 8*b* on its side facing the ski 1, which hook assures an engagement with the bight portion of the spring bar 7 over the entire range of movement of the ski brake 5. In this case, the longitudinal slots 17 can be left out. For the purpose of preventing an unintended loosening of the spring bar 7 from the stepping plate 8 and thus from the braking bar 6, the course of swing of the entire ski brake 5 is limited. This can be done either by arranging a stop 21 on the mounting plate 4 selectively in the path of swing of the braking bar 6 or the spring bar 7 or it can be arranged on the opposite side of the pivots therefor (in relationship to the swinging of the ski brake) on the mounting plate 4 or on the ski 1 so that further swinging of the braking arms 13 will be limited. The stop 21, as is shown in FIG. 1*b*, is arranged most advantageously in the path of the swing of the spring bar 7 because here neither insertion of the ski boot 2 is hindered nor is an outwardly projecting part created which projects outwardly during downhill skiing. The arrangement has the further advantage that the ski brake 5 upon creation of an overload can swing also beyond the limit of the stop 21 because the component of movement which is created transversely with respect to the longitudinal direction of the ski exerts the necessary axial force onto the associated free end 7*c* of the spring bar 7 and a sliding off over the stop 21 can occur.

The entire arrangement can be adjustably mounted in a conventional manner for movement in longitudinal direction of the ski separately from ski binding 3 or otherwise together with the ski binding 3. This embodiment has the advantage that the mounting plate 4 can be constructed at the same time as a sliding plate so that a separate mounting for the ski brake 5 or a separate sliding plate for the ski binding 3 is not needed. As a result, the friction forces which disadvantageously stress the ski boot 2 or its sole during a release operation are reduced.

Figure 4:
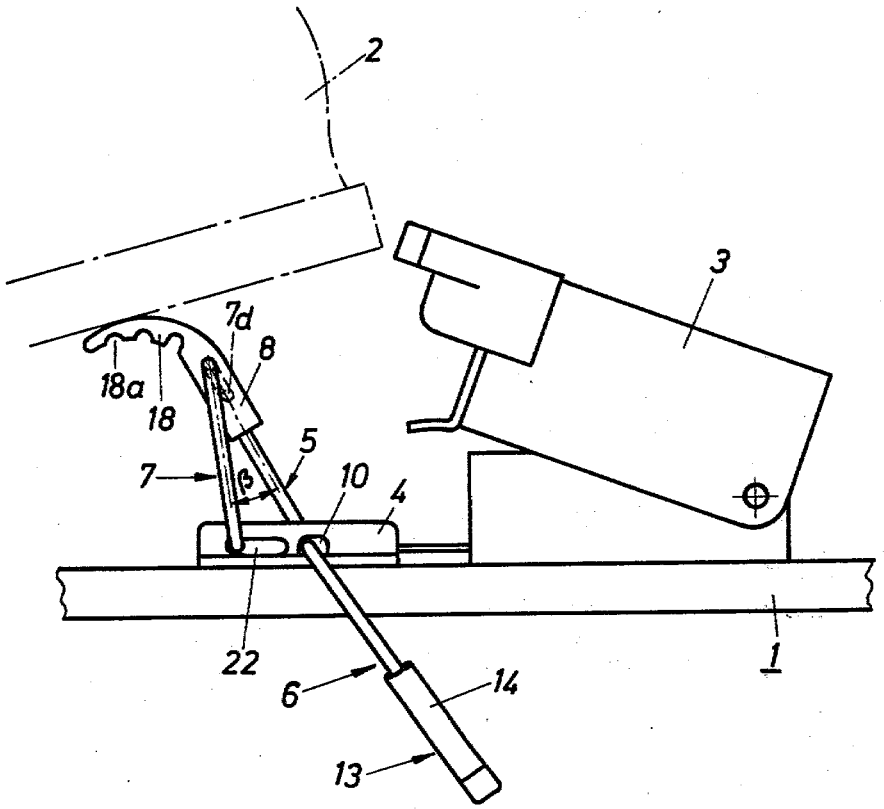
FIGS. 4 to 6 illustrate a second exemplary embodiment, similar to the positions of FIGS. 1 to 3.
Figure 5:
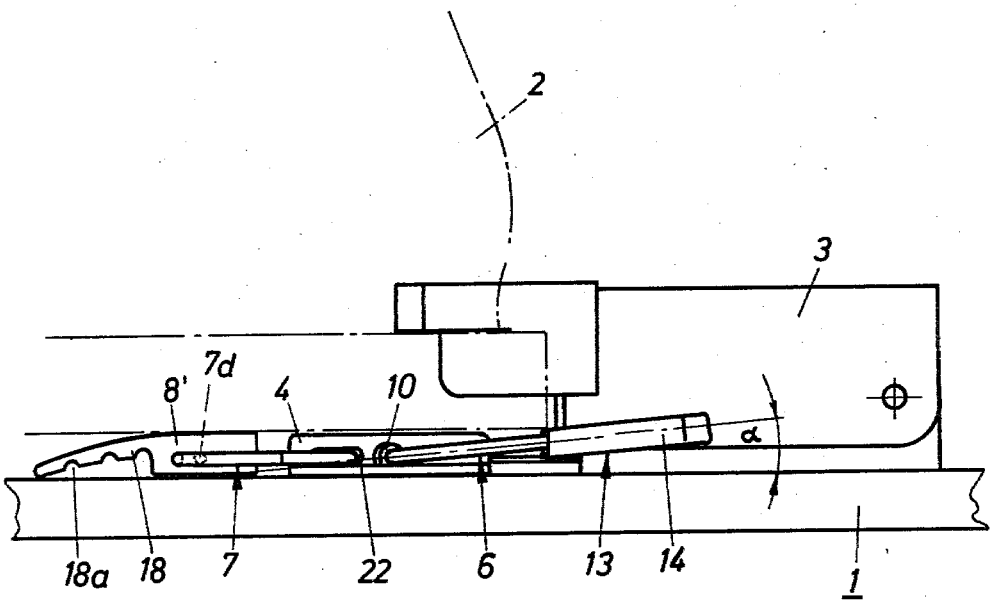
Figure 6:
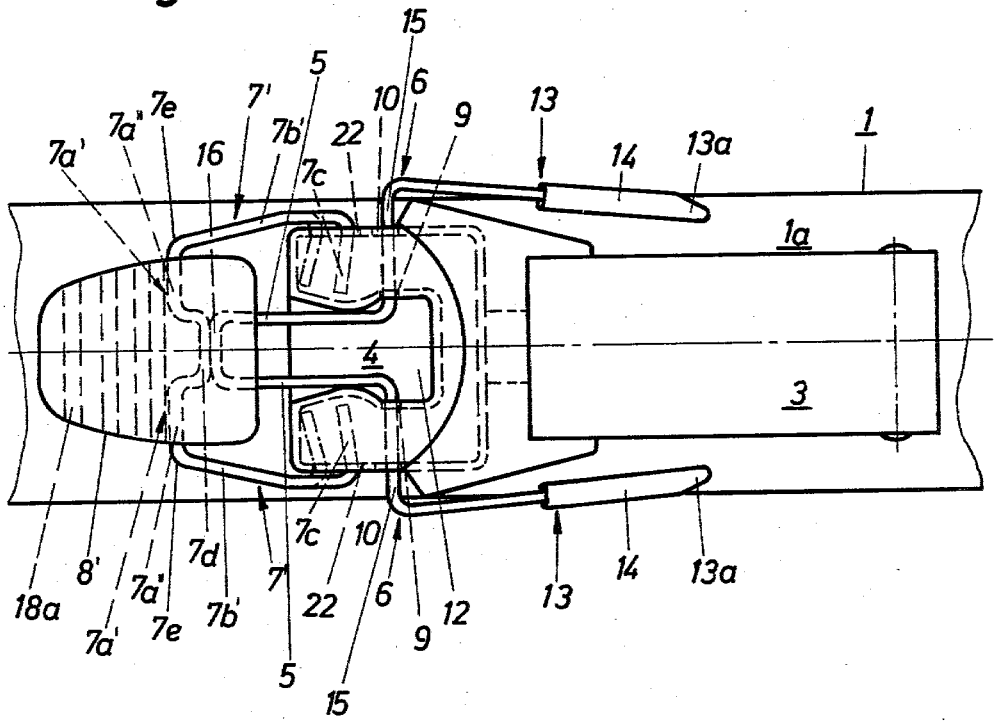

In the second exemplary embodiment according to FIGS. 4 to 6, the difference from the preceding embodiments lies in the bight portion 7*a'* of the spring bar 7' having a cranklike portion 7*d* which is positioned in an associated (not separately illustrated) recess of the stepping plate 8' and is form-lockingly connected to same. To assure the swing movement according to this exemplary embodiment, the free ends 7*c* of the spring bar 7' are freely movably supported in elongated slots 22 in the mounting plate 4, which elongated slots 22 are arranged on both sides of the mounting plate 4 and act as a type of sliding axle. In this arrangement, not only do the two legs act as torsion segments 7*b'* but also the remaining two segments 7*a''* of the bight portion 72*a'* are positioned transversely with respect to the longitudinal direction of the ski. The crank portion 7*d* and the bent portions 7*e*, which exist between the two torsion areas 7*a''* and 7*b''* which lie one behind the other, are neutral. In order to be complete, it is remarked that the lateral torsion segments, 7*b'* receive torsion through the bent portions of the free ends 7*c* and the torsion segments 7*a''* receive torsion through the sliding axles. The torsion force is achieved between the crank portion 7*d* and the stepping plate 8 in that the planes of the crank portion 7*d* and of the braking bar 7 form an acute angle $\beta$ with one another in the braking position of the ski brake 5. A comparison of the positions of the crank 7*d* and of the spring bar 7 to one another according to FIGS. 4 and 5 will reveal the change of the angle $\beta$ and thus the initial tension in the ready or cocked position of the ski brake 5.

The invention is not limited to the illustrated exemplary embodiments. Various modifications are possible without departing from the scope of the invention. For example, the braking bar can be manufactured not only as illustrated of a spring wire, but also with any desired different cross section, namely both of plastic and also of a light metal U-shaped casting or also of a sheet metal material. The approximately U-shaped shape refers to a view in longitudinal direction of the ski. It is also possible that the lateral resiliency of the braking bar is created—not as illustrated by lateral abutting surfaces, constructions or the like—but for example by a hinged connection of two half bar parts which are held together by means of a spring. Such an embodiment is described for example in U.S. Pat. No. 4,124,223, assigned to the same assignee as the present invention. The use of lateral limitations is known for example from German OS No. 24 36 155.

Although particular embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A ski brake for preventing free flight of a ski upon the release thereof from a ski boot, comprising:

a mounting plate on the upper surface of said ski;

a first U-shaped wire bar mounted on said mounting plate by first mounting means for pivotal movement between an inoperative position wherein a first bight of said wire bar lies substantially along said upper surface and an operative position wherein said first bight is upstanding from said upper surface, the legs of said U-shaped wire bar each having a segment therein bent to extend at a right angle to the longitudinal axis of said ski, said leg segments being axially aligned and defining the pivot axle for said first U-shaped wire bar;

at least one brake arm mounted on said first U-shaped wire bar and adapted to swing from a position wherein it lies along a longitudinal edge of the ski into a position in which it projects below a running surface of the ski upon movement of said first bight between said inoperative position and said operative position;

a second U-shaped spring wire bar mounted on said mounting plate by second mounting means for pivotal movement about an axis spaced along the longitudinal axis of said ski from and parallel to said pivot axle and between an inoperative position wherein a second bight of said wire bar lies substantially along said upper surface of said ski and an operative position wherein said second bight is upstanding from said upper surface of said ski;

spring means bearing upon said second U-shaped spring wire bar for biasing same into said operative position;

a stepping plate connected to said first bight by third mounting means and connected to said second bight by fourth mounting means; and one of said mounting means comprising lost motion connection means for facilitating a compensation for the change in spacing between said first and second U-shaped bars when said first and second U-shaped wire bars are pivoted simultaneously between said inoperative positions and said operative positions whereby said spring means provides the sole force to effect a movement of both of said first and second U-shaped bars simultaneously from said inoperative position to said operative position without deformation of said first U-shaped bar.

2. The ski brake according to claim 1, wherein said second U-shaped spring wire bar comprises said spring means, said second wire bar having a pair of leg segments connected to said second bight to define a planar arrangement and a pair of offset segments connected to said leg segments and lying in a plane different from the plane of said bight and leg segments, said second mounting means engaging said offset segments to limit the ability of said second wire bar to freely pivot toward said upper surface of said ski so that a displacement of said second bight toward said upper surface of said ski will distort said spring wire bar resiliently.

3. The ski brake according to claim 1, wherein said fourth mounting means comprises an elongated opening in said stepping plate, the axis of which extends horizontally above the upper surface of said ski and perpendicular to a vertical plane through the longitudinal axis of said ski, said opening being elongated in a direction parallel to the longitudinal axis of said ski when said stepping plate is adjacent said upper surface of said ski and said first and second U-shaped bars are in said inoperative position, said second bight being received in said elongated opening whereby said elongated opening with said second bight therein defines said lost motion connection means.

4. The ski brake according to claim 3, wherein said elongated opening is an elongated slotlike hook on the underside of said stepping plate, and wherein said mounting plate has a stop thereon engaging said second wire bar to limit the position thereof in the upright operative position.

5. The ski brake according to claim 1, wherein said second mounting means is said lost motion connection means and comprises a pair of elongaged slots which extend in longitudinal direction of the ski, in which elongaged slots the free ends of said second spring wire bar are held as sliding axles, and wherein said second spring wire bar is pivotally connected to said stepping plate.

6. The ski brake according to claim 5, wherein said second bight has a crank portion which is arranged centrally and symmetrically with respect to the longitudinal center plane of the ski brake and is fixedly held in said stepping plate, wherein the planes of said crank portion and said U-shaped spring wire bar define an acute angle ($\beta$) with one another in said operative position of said ski brake whereby a displacement of the second U-shaped wire bar toward said upper surface of said ski will distort said second U-shaped bar resiliently between said crank portion and the free ends thereof.

7. The ski brake according to claim 1, wherein said stepping plate has an extension thereon at its end zone facing said ski boot, which extension consists of the material of said stepping plate and means effecting a greater flexibility of said extension than said stepping plate.

8. The ski brake according to claim 7, wherein said means on said extension includes recesses on its area facing said ski.

9. The ski brake according to claim 7, wherein said extension includes a rounded off end at its free end.

10. The ski brake according to claim 7, wherein said means effecting a great flexibility of said extension includes a pivot axis securing said extension to said end zone of said stepping plate, wherein between said stepping plate and said extension there is arranged a spring.

11. The ski brake according to claim 1, including a pair of braking arms, wherein said braking arms extend upwardly in said inoperative position of said ski brake and define an acute angle in the range of 5° to 20°, with said upper surface of said ski.

12. The ski brake according to claim 1, wherein said stepping plate has an extension thereon on an end thereof remote from said first U-shaped bar, and wherein said extension is pivotally secured to said stepping plate.

13. The ski brake according to claim 1, wherein said acute angle is 10°.

14. A ski brake for preventing free flight of a ski upon the release thereof from a ski boot, comprising:

a mounting plate on the upper surface of said ski;

a first U-shaped wire bar mounted on said mounting plate by first mounting means for pivotal movement between a fully inoperative position wherein a first bight of said wire bar lies substantially along said upper surface and an operative position wherein said first bight is upstanding from said upper surface and through an initial inoperative position between said fully inoperative and said operative positions, the leg segments of said U-shaped wire bar each having a segment therein bent to extend generally at a right angle to the longitudinal axis of said ski, said leg segments being axially aligned and defining an operative pivot axle for said first U-shaped wire bar;

at least one brake arm mounted on said first U-shaped wire bar and adapted to swing from a fully inoperative position corresponding to said fully inoperative position of said first U-shaped wire bar wherein said brake arm lies above the upper surface of said ski to an initial inoperative position corresponding to said initial inoperative position of said first U-shaped wire bar wherein said brake arm lies along a longitudinal edge of the ski and into an operative position corresponding to said operative position of said first U-shaped wire bar wherein said brake arm projects below a running surface of the ski upon movement of said first bight between said inoperative position and said operative position thereof;

a second U-shaped spring wire bar mounted on said mounting plate by second mounting means for pivotal movement about an operative pivot axis spaced along the longitudinal axis of said ski from and generally parallel to said operative pivot axle and between an inoperative position wherein a second bight of said wire bar lies substantially along said upper surface of said ski and an operative position wherein said second bight is upstanding from said upper surface of said ski;

spring means bearing upon said second U-shaped spring wire bar for biassing same and said first U-shaped wire bar into said operative position;

a stepping plate connected to said first bight by third mounting means and connected to said second bight by fourth mounting means; and means for effecting a movement in of said brake arm over said upper surface of said ski in response to a movement of said first U-shaped wire bar from said initial inoperative toward said fully inoperative positions thereof;

one of said mounting means comprising lost motion connection means for facilitating a compensation for the change in spacing between said first and second U-shaped wire bars when said first and second U-shaped wire bars are pivoted between said inoperative positions and said operative positions thereof whereby said spring means provides the sole force to effect a pivotal movement of both of said first and second U-shaped wire bars simultaneously at least from said initial inoperative positions to said operative positions thereof.

15. The ski brake according to claim 14, wherein said means for effecting a movement in of said brake arm over said upper surface of said ski includes a cam surface on said mounting plate which effects an axial movement of at least one of said leg segments as said first U-shaped bar moves between said initial inoperative and said fully inoperative positions thereof.

16. The ski brake according to claim 15, wherein said operative pivot axle remains stationary relative to the longitudinal axis of said ski while said leg segment moves axially.

* * * * *

UNITED STATES PATENT AND TRADEMARK OFFICE

CERTIFICATE OF CORRECTION

PATENT NO. : 4 239 256

DATED : December 16, 1980

INVENTOR(S) : Erwin Krob et al

It is certified that error appears in the above—identified patent and that said Letters Patent is hereby corrected as shown below:

Column 2, line 4; after "created" insert ---again---.
line 18; change "breaking" to ---braking---.
Column 3, line 32; change "overloaded" to ---overload---.
line 64; after "This" insert ---angle---.
Column 5, line 41; change "72a' " to ---7a'---.
line 45; change "7b" " to ---7b'---.
Column 7, line 30; change "elongaged" to ---elongated---.
line 32; change "elongaged" to ---elongated---.
line 60; change "great" to ---greater---.
Column 8, line 6; change "claim 1" to ---claim 11---.

Signed and Sealed this

*Seventeenth* Day of *March 1981*

[SEAL]

*Attest:*

RENE D. TEGTMEYER

*Attesting Officer*

*Acting Commissioner of Patents and Trademarks*